US007448641B2

(12) United States Patent
Buquet et al.

(10) Patent No.: US 7,448,641 B2
(45) Date of Patent: Nov. 11, 2008

(54) ADJUSTMENT DEVICE FOR AN ACCESSORY SUCH AS A SKI BINDING HEELPIECE

(75) Inventors: Thierry Buquet, Coulanges les Nevers (FR); Frédéric Farges, Nevers (FR); Hans-J Horn, Berne (CH); Christian Lucas, Nevers (FR); Gérard Thomas, Urzy (FR)

(73) Assignee: Look Fixations S.A., Nevers (FR)

( * ) Notice: Subject to any disclaimer, the term of this patent is extended or adjusted under 35 U.S.C. 154(b) by 245 days.

(21) Appl. No.: 11/252,863

(22) Filed: Oct. 18, 2005

(65) Prior Publication Data

US 2006/0091643 A1 May 4, 2006

(30) Foreign Application Priority Data

Oct. 28, 2004 (FR) ..... 04 11478

(51) Int. Cl.
*A63C 5/00* (2006.01)

(52) U.S. Cl. ..... 280/607; 280/611; 280/613

(58) Field of Classification Search ..... 280/611, 280/613, 617, 618, 607
See application file for complete search history.

(56) References Cited

U.S. PATENT DOCUMENTS 3,987,553 A * 10/1976 Salomon ..... 33/562
4,403,785 A * 9/1983 Hottel ..... 280/14.23
4,620,719 A 11/1986 Stritzl
5,738,364 A 4/1998 Zotter et al.
5,762,358 A * 6/1998 Hale ..... 280/607
5,879,020 A * 3/1999 Buquet ..... 280/633
6,189,899 B1 * 2/2001 Carlson ..... 280/14.22
6,428,032 B1 * 8/2002 Humbel ..... 280/613
7,063,346 B2 * 6/2006 Elkington ..... 280/618

FOREIGN PATENT DOCUMENTS

FR 2 761 611 10/1998
FR 2 775 195 8/1999

* cited by examiner

*Primary Examiner*—Christopher Ellis
*Assistant Examiner*—Brian Swenson
(74) *Attorney, Agent, or Firm*—Frommer Lawrence & Haug LLP; Ronald R. Santucci

(57) ABSTRACT

A device for the adjustable fastening of an accessory on a gliding board, which comprises a base comprising means for fastening the accessory and which accommodates a bar having a toothed part suitable for positioning in a complementary toothed part secured to the gliding board, which device comprises a crank that can rotate within the base and one end of which is connected to a lever, and wherein the bar has one degree of freedom and a part in contact with the bent part of the crank, so that a first position of the lever corresponds to the low position of the toothed part and a second position corresponds to a high position of the toothed part.

12 Claims, 6 Drawing Sheets

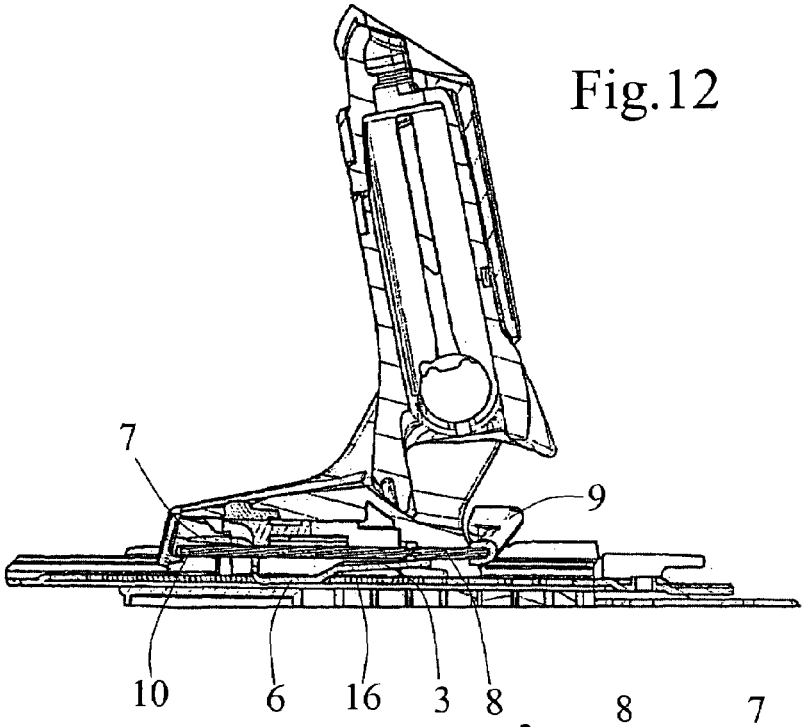
Fig.12
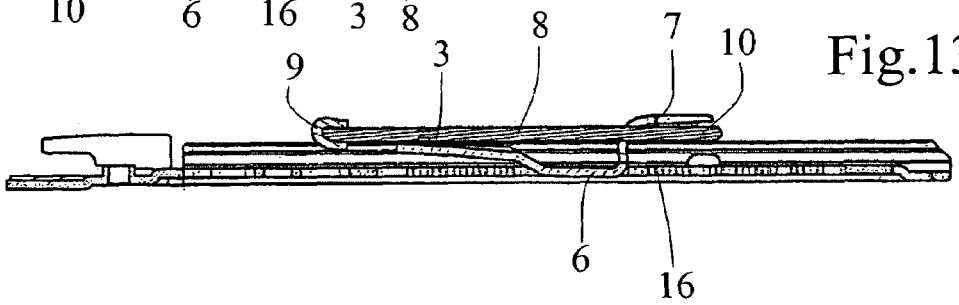
Fig.13
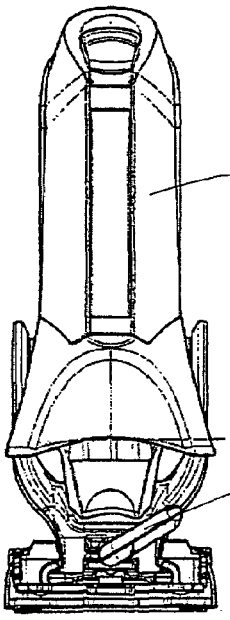
Fig.15
Fig.14
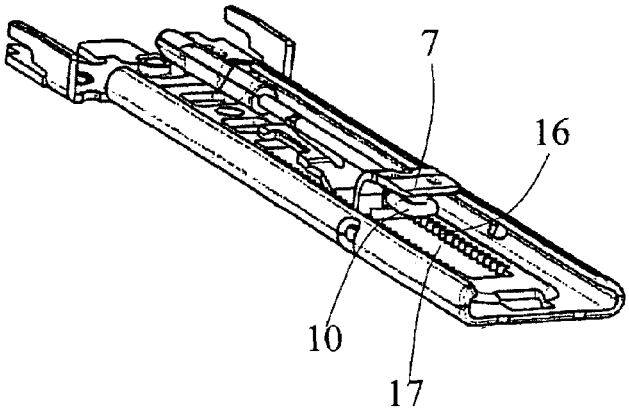

Fig.16
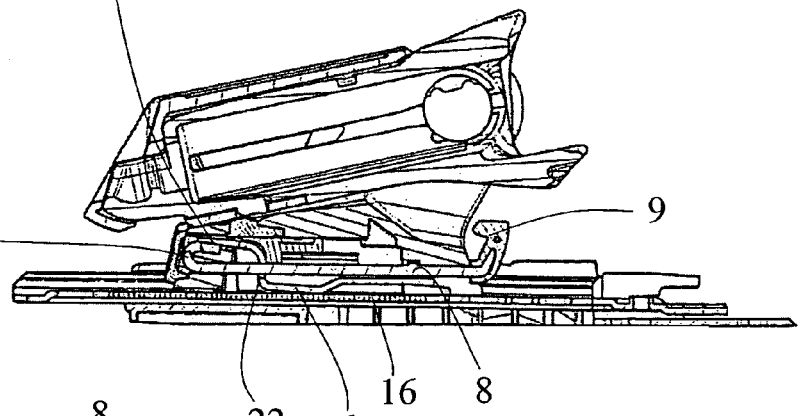
Fig.17
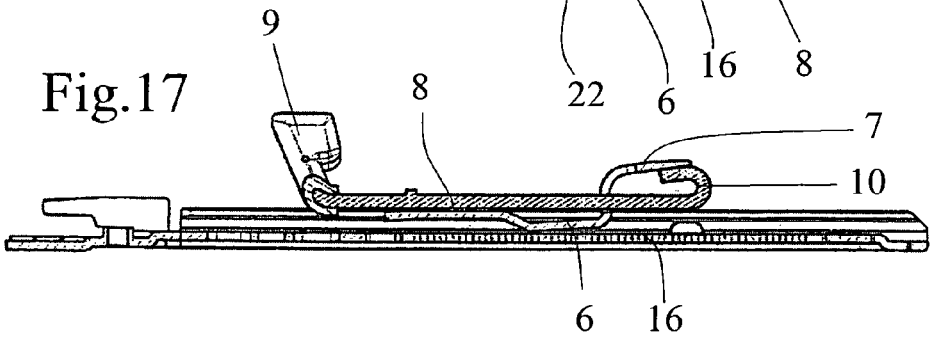
Fig.18
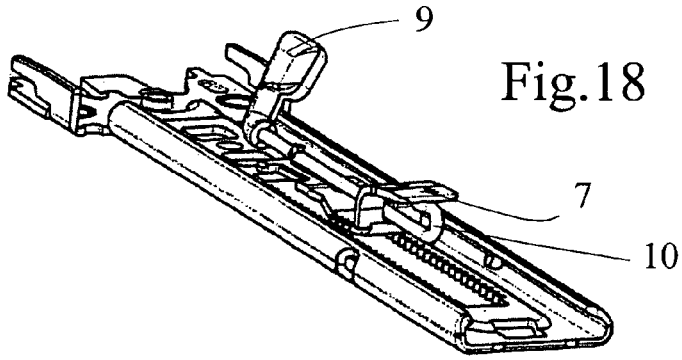
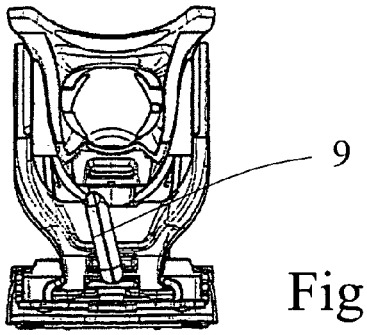
Fig.19

ADJUSTMENT DEVICE FOR AN ACCESSORY SUCH AS A SKI BINDING HEELPIECE

This application claims priority benefits from French Patent Application No. 04 11478 filed Oct. 28, 2004.

BACKGROUND OF THE INVENTION

The invention relates to a device for the adjustable fastening of an accessory on a gliding board, which is suitable in particular for fastening a heelpiece of a ski boot binding device on a ski, allowing it to be longitudinally adjusted.

DESCRIPTION OF THE PRIOR ART

Various devices are known which make it possible to adjust the longitudinal position of a heelpiece of a ski boot binding device in order to adapt the binding to different boot lengths. A common solution in the prior art is based on the one hand on an element positioned on the ski having guide rails and a toothed part and, on the other hand, on a heelpiece mounted on a base and provided with guide rails and with a toothed part, these being complementary. The two complementary toothed parts can interlock and block the longitudinal displacement of the heelpiece in the rails. A means for releasing these toothed parts makes it possible to displace the heelpiece in order to adjust its position. All the existing solutions have drawbacks, however, including:

- they require a tool for releasing the toothed parts. This tool has to be introduced through an opening and held in position during the adjustment. In this case, the solutions are not user-friendly and are poorly suited for adjusting rapidly and under all conditions, for example on ski runs where the specific tool is not always available; and/or
- they are complex, because they are based either on a large number of elements or on elements which are complex to manufacture or assemble; and/or
- they are sometimes unattractive because unattractive mechanical elements are visible; and/or
- they are bulky and increase the overall size of the accessory to be mounted on the gliding board; and/or
- they are not reliable, i.e. they may lead to accidental maladjustments of the position of the accessory during their use, which is dangerous because it may cause the skier to fall.

SUMMARY OF THE INVENTION

There is now a need for another solution of a device for the adjustment of an accessory on a gliding board.

It is a general object of the present invention to provide a device for the adjustable fastening of an accessory on a gliding board which does not have the aforementioned drawbacks.

More precisely, it is a first object of the invention to provide a device for the adjustable fastening of an accessory on a gliding board which is user-friendly and easy to use under all conditions.

It is a second object of the invention to provide a device for the adjustable fastening of an accessory on a gliding board which is simple and easy to assemble.

It is a third object of the invention to provide an esthetically attractive device for the adjustable fastening of an accessory on a gliding board.

It is a fourth object of the invention to provide a compact device for adjustable fastening.

It is a fifth object of the invention to provide a device for the adjustable fastening of an accessory on a gliding board which allows fastening in full safety.

The invention is based on a device for the adjustable fastening of an accessory on a gliding board, which comprises a base comprising means for fastening the accessory and which accommodates a bar having a toothed part suitable for positioning in a complementary toothed part secured to the gliding board, which device comprises a crank that can rotate within the base and one end of which is connected to a lever, and wherein the bar has one degree of freedom and a part in contact with the bent part of the crank, so that a first position of the lever corresponds to the low position of the toothed part and a second position corresponds to a high position of the toothed part.

The bar may be fastened to the base at one end, the part in contact with the crank lying toward the other end.

As a variant, the bar may be arranged in the longitudinal direction of the base, the toothed part lying substantially in the central part of the base.

A spring may be mounted in the base so as to exert a downward force on the toothed part of the bar.

The crank may be transverse to the base and have the bent part in its central part, the lever lying in a lateral zone outside the base. The lever may then have a direction substantially parallel to the gliding board when the toothed part is in its low position, and a position at an angle of about 45 degrees upward when the toothed part is in its high position.

As a variant, the crank may be arranged longitudinally to the base and have the bent part toward its end, the lever lying in a zone to the front or rear of the base. The lever may then have a direction substantially parallel to the gliding board when the toothed part is in its low position, and a position raised by one fourth of a turn when the toothed part is in its high position.

In one embodiment, the base comprises at least one location for receiving a ski binding heelpiece, and the lever is positioned toward the front end of the base intended to receive a ski boot.

The invention also relates to a ski binding heelpiece, which comprises a device as described above for adjustable fastening of its longitudinal position on a gliding board.

It also relates to the assembly consisting of the device as described above for fastening an accessory on a gliding board and an element which is intended to be securely fastened on the gliding board and comprises a toothed part corresponding to the toothed part of the bar.

Lastly, the invention also relates to a ski comprising a device as described above.

BRIEF DESCRIPTION OF THE DRAWINGS

Embodiments are described below by way of example with reference to the appended drawings, in which:

FIG. 12 represents a sectional side view of the device according to the second embodiment in a first configuration;

FIG. 13 represents a sectional view of details of the second embodiment of the invention in the first configuration;

FIG. 14 represents a perspective view of details of the second embodiment of the invention in the first configuration;

FIG. 15 represents a front view of the second embodiment of the invention in the first configuration;

FIG. 16 represents a sectional side view of the device according to the second embodiment in a second configuration;

FIG. 17 represents a side view of details of the second embodiment of the invention in the second configuration;

FIG. 18 represents a perspective view of details of the second embodiment of the invention in the second configuration;

FIG. 19 represents the front view of the second embodiment of the invention in the second configuration.

DESCRIPTION OF THE PREFERRED EMBODIMENTS

Figure 1:
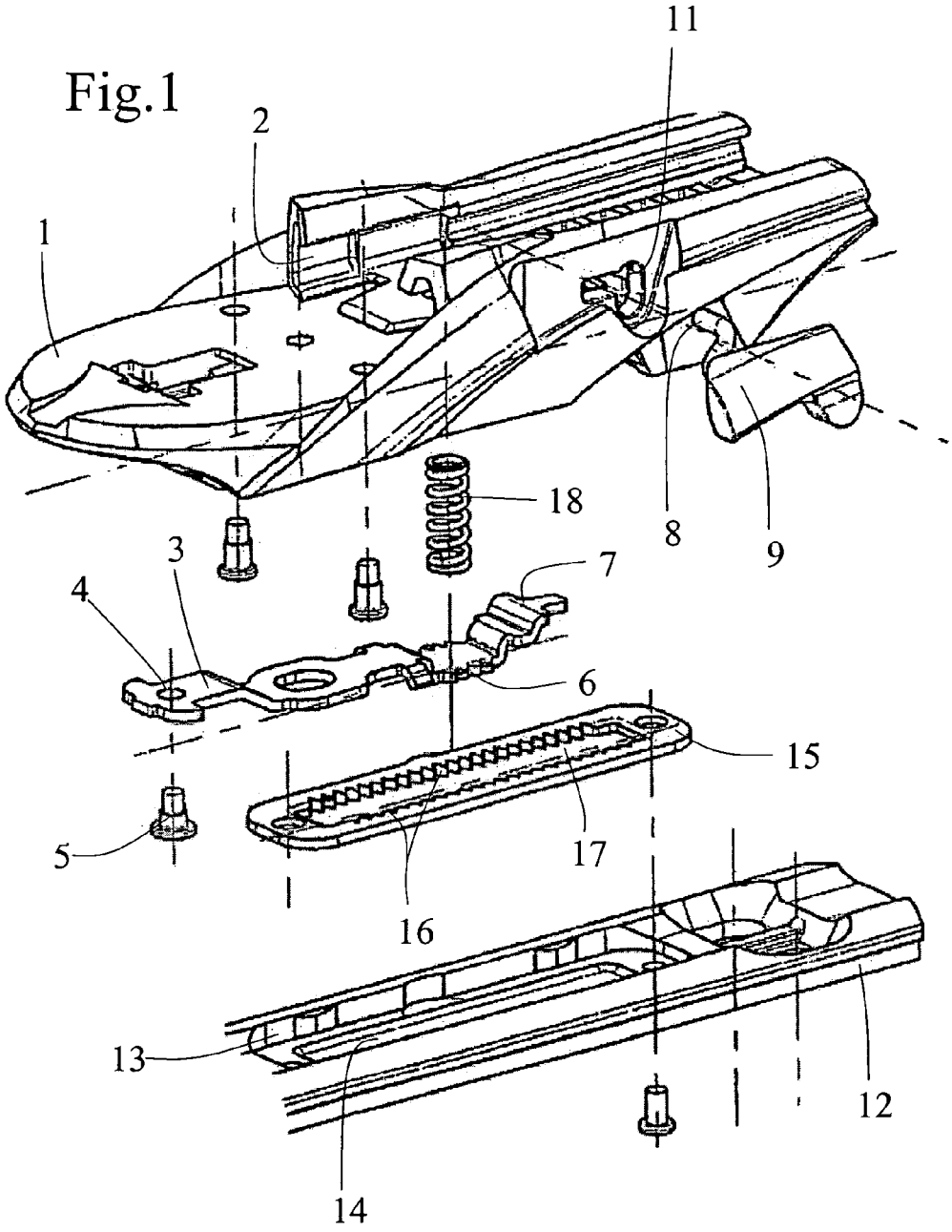
FIG. 1 represents an exploded perspective view of a first embodiment of the invention.

A first embodiment of the invention is illustrated in FIGS. 1 to 10. The device for the adjustable fastening of an accessory on a gliding board according to this embodiment comprises a base 1, on which two lateral rails 2 are positioned in order to make it possible to position an accessory on the base 1 then fasten it. A bar 3, comprising an opening at a first end 4 to receive a screw 5 in order to be fastened on the base and comprising a free surface 7 at the other end, which is intended to cooperate with a crank 8 actuated by a lever 9, is positioned within the base 1 in the longitudinal direction of the base. The bar 3 comprises a toothed part 6 in a lower plane, which is intended to cooperate with a complementary toothed part connected to the gliding board, as will be illustrated below.

Figure 2:
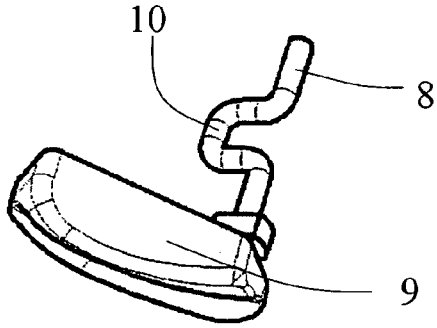
FIG. 2 represents a perspective view of the crank of the embodiment in FIG. 1.
Figure 3:
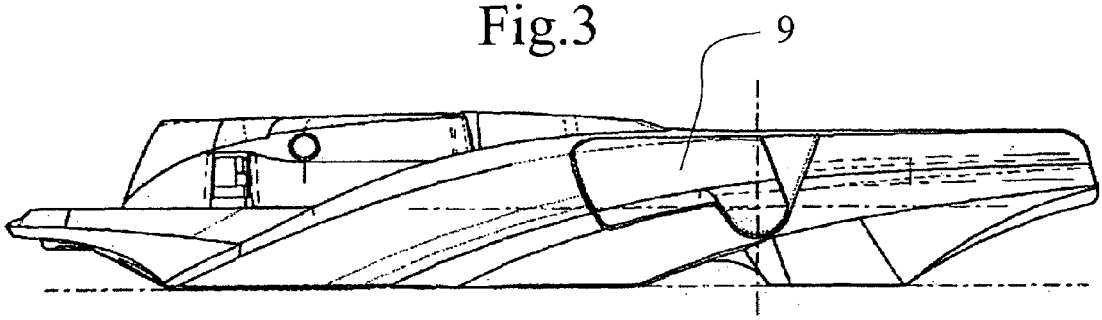
FIG. 3 represents a side view of the first embodiment of the invention in a first configuration.
Figure 4:
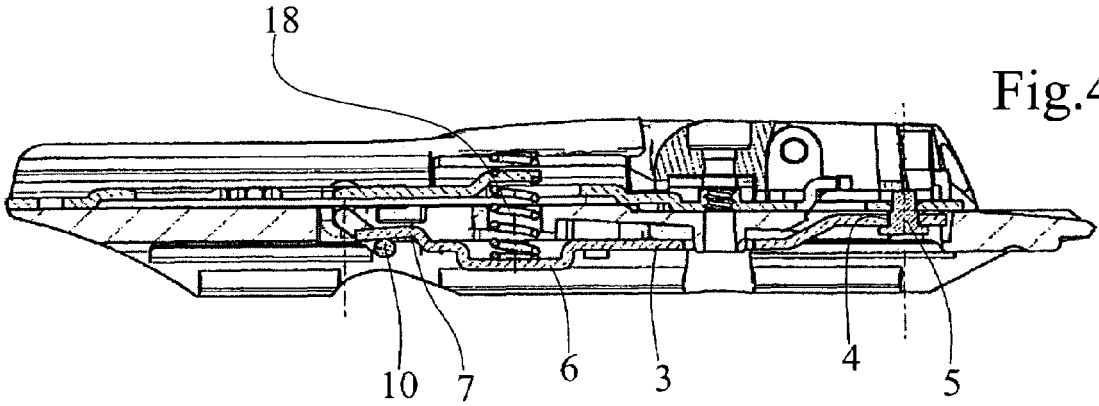
FIG. 4 represents a sectional view of the first embodiment of the invention in the first configuration.
Figure 5:
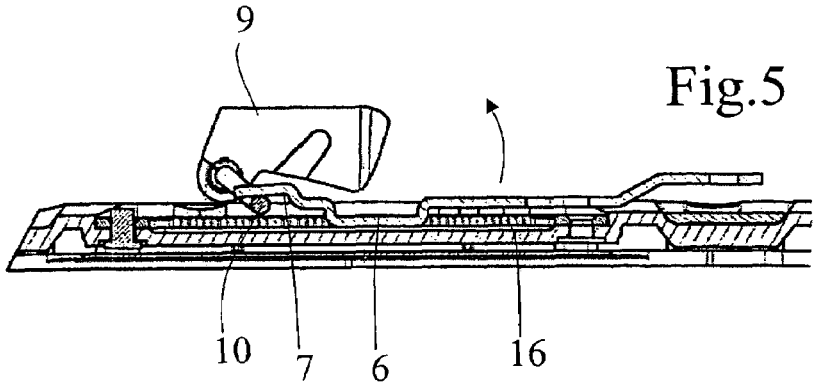
FIG. 5 represents a sectional view of details of the first embodiment of the invention in the first configuration.

The crank 8 comprises a bent part 10 in its central part, which is represented in FIG. 2. This is positioned through a lateral opening 11 of the base 1, transversely to the base 1 and to the bar 3, so that its bent part 10 is in contact with the lower surface of the end 7 of the bar 3. It comprises its two fixed ends which can rotate on the side walls of the base 1, one of its ends therefore resting on the opening 11 of the base and passing through it in order to be connected to the lever 9, which is thus positioned laterally outside the base 1.

FIGS. 3 to 6 illustrate the device in a first configuration, in which the base 1 is fastened on the gliding board and cannot move. In this configuration, the lever 9 is oriented parallel to the longitudinal axis of the base 1 and the bent part 10 is oriented toward the base, at an angle of 45 degrees relative to the vertical. In this configuration, the bar 3 occupies a overall position parallel to the base 1, its toothed part 6 being positioned in its lowermost position.

Figure 6:
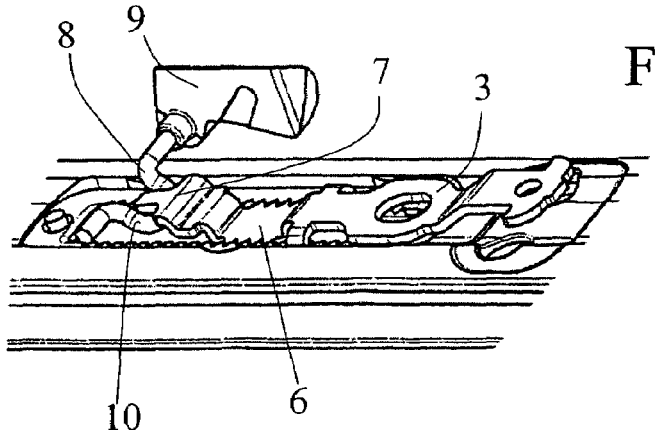
FIG. 6 represents a perspective view of details of the first embodiment of the invention in the first configuration.
Figure 7:
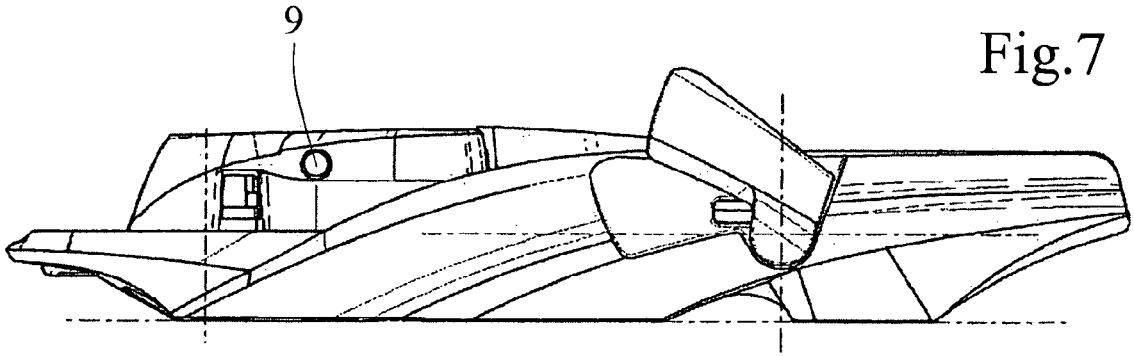
FIG. 7 represents a side view of the first embodiment of the invention in a second configuration.
Figure 8:
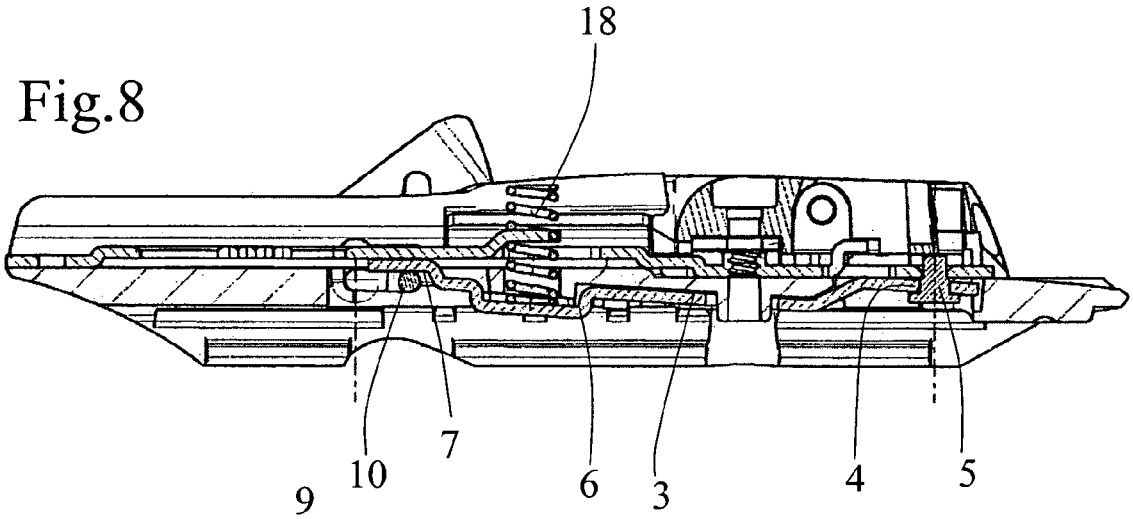
FIG. 8 represents a sectional view of the first embodiment of the invention in the second configuration.
Figure 9:
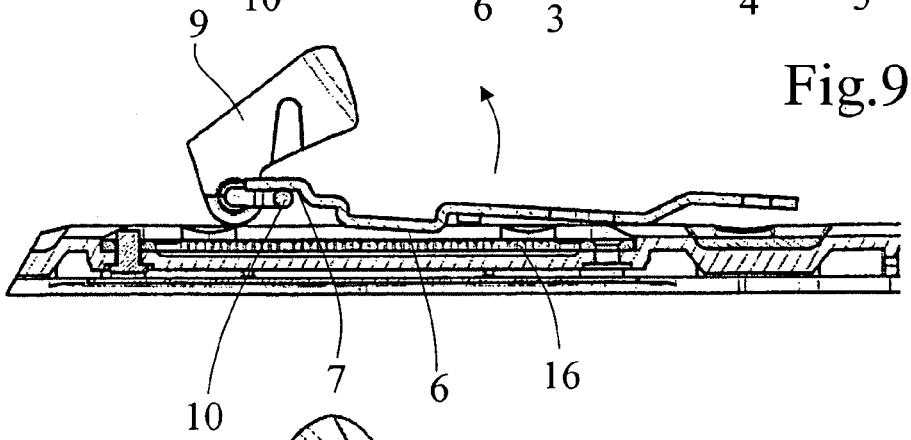
FIG. 9 represents a sectional view of details of the first embodiment of the invention in the second configuration.
Figure 10:
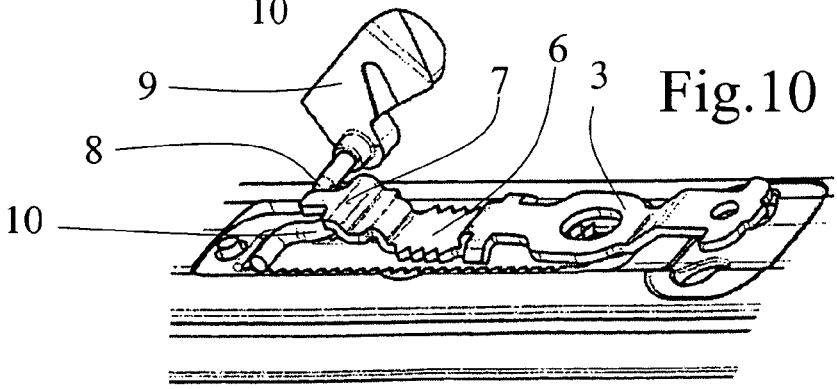
FIG. 10 represents a perspective view of details of the first embodiment of the invention in the second configuration.

As can be seen in FIGS. 1 and 6, this adjustable fastening device is fastened on a gliding board by means of an element 12 fastened on the gliding board, comprising two lateral guide rails 13 cooperating with lateral rails (not shown) on the lower face of the base 1, and comprising a central opening in which an element 15 comprising two lateral toothed parts 16 framing an opening 17 is positioned. The toothed parts 16 have teeth oriented toward the opening 17, the dimensions of which correspond to those of the toothed part 6 of the bar 3.

In this configuration, the teeth of the toothed part 6 are therefore positioned between the teeth of the toothed parts 16 of the element 12, as can be seen clearly in FIG. 6, thus preventing any longitudinal sliding of the base 1 in the guide rails 13.

A spring 18 is mounted within the base so as to exert a downward pressure force on the toothed part 6 of the bar 3, thus helping to maintain the fastening position of this first configuration.

FIGS. 7 to 10 illustrate the adjustable fastening device according to the first embodiment in a second configuration, in which the base 1 can move longitudinally on the gliding board.

In this configuration, the lever 9 has been raised by a rotation of about 45 degrees, causing the crank to rotate so that its bent part 10 occupies a raised position such that the crank lies in a plane substantially parallel to the base 1. By this movement, the bent part 10 of the crank 8 moves the ends 7 of the bar 3 upward. This movement is made possible by the freedom of this end 7 of the bar 3 and the connection of the metal bar 3 on the base 1 at its opposite point 4, which, owing to its flexibility, allows all of the bar to rotate relative to this fastening point. This overall movement of the bar 3 therefore causes an upward displacement of the toothed part 6, which is sufficient to release its teeth from engagement with the toothed parts 16. In this configuration, the base 1 can thus slide in the rails 13 of the element 12, which allows it to be displaced longitudinally. Rotating the lever 9 into the first configuration blocks this movement again. This device therefore makes it possible to adjust the position of the base 1 on the gliding board, and thus consequently to adjust the position of the accessory which it supports.

Lastly, this solution has the following advantages:

- it functions with a simple lever which is easy to operate, and is therefore a user-friendly solution;
- the solution has few parts and is simple to assemble;
- since the toothed part 6 is positioned in the central zone of the base 1, the solution allows the base 1 on which the accessory is mounted to travel in such a way which optimally conceals the fastening system secured to the gliding board in all its positions, and in particular the element 15 which is not esthetically attractive;
- since the actuation device is based on a crank, the additional bulk imposed on the device consists of a simple bent arm of small diameter, the movement of which requires a small amplitude, which makes it possible to obtain a compact solution.

FIGS. 11 to 19 illustrate a second embodiment of the invention, in which the same references are used for the corresponding elements.

Figure 11:
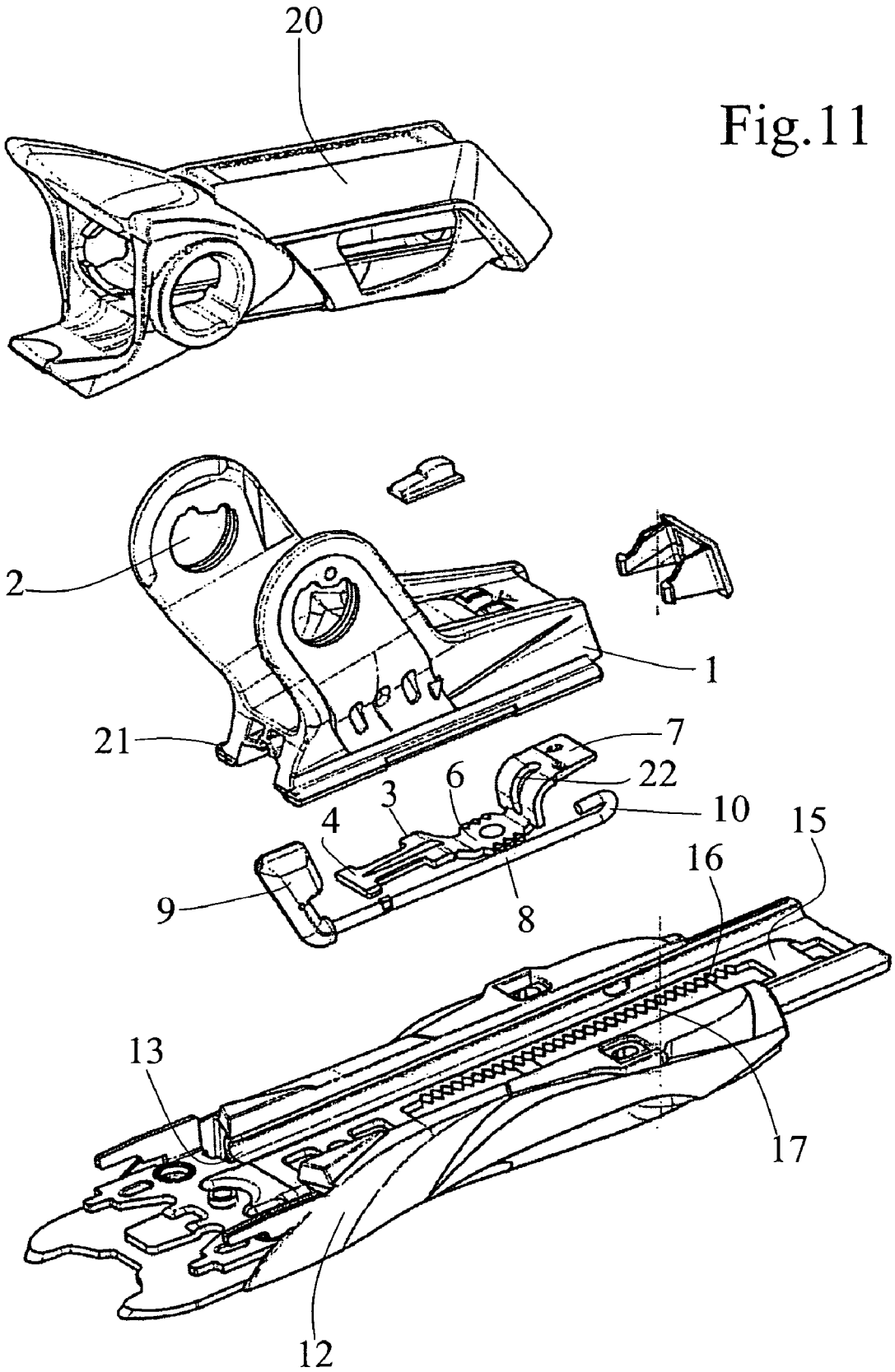
FIG. 11 represents an exploded perspective view of a second embodiment of the invention.

As illustrated in FIG. 11, this device is composed of a base 1 comprising means 2 for fastening a heelpiece 20. A bar 3 having a free surface 7, a toothed part 6 and a zone fixed on the base 4 is mounted in the lower part of the base 1 in the longitudinal direction of the base. A major difference from the first embodiment is that the crank 8 is oriented in the longitudinal direction of the base. The crank 8 is connected to a lever 9 and has a bent part 10 at its opposite end, which cooperates with the surface 7 of the bar. This device cooperates with an element 12 of a ski, which comprises guide rails 13 for receiving the corresponding rails 21 of the base 1, and an element 15 having two toothed parts 16 surrounding a space 17 intended for positioning the toothed part 6 of the bar 3. The crank 8 is positioned in the longitudinal direction of the base, overall above the bar 3 and parallel to it, and can rotate within the base. The crank 9 lies to the front of the heelpiece, and the other end of the crank passes through an opening of the bar 22 in order to position its bent part 10 in contact with the lower surface of the zone 7 of the bar 3.

FIGS. 12 to 15 illustrate the device of the second embodiment in a first configuration, in which the base 1 is fastened to the gliding board and cannot move. In this configuration, the lever 9 is oriented substantially parallel to the plane of the ski, under the jaw of the heelpiece 20. The effect of positioning a ski boot in the heelpiece is therefore to block the access and rotation of the lever 9, which ensures that its position is maintained. The bent part 10 occupies a plane parallel to the ski, and the bar 3 occupies a position overall parallel to the base 1, its toothed part 6 being positioned in its lowermost position between the toothed parts 16 of the element 15.

FIGS. 16 to 19 illustrate the adjustable fastening device in a second configuration, in which the base 1 can move longitudinally on the ski. In this configuration, the lever 9 has been raised by a rotation of about 90 degrees, causing the crank 8 to rotate so that its bent part 10 occupies a raised position, in a plane substantially parallel to the base 1. By this movement, the bent part 10 of the crank 8 moves the ends 7 of the bar 3 upward, the effect of which is to release the toothed part 6 of the bar from the corresponding toothed part 16, in the same way as in the previous embodiment.

Lastly, this second embodiment has the same advantages as the first and offers extra safety in the case of a ski binding, for example, by allowing the lever to be positioned under the boot in the fastening position in order to prevent any accidental actuation.

The invention claimed is:

1. A device for the adjustable fastening of an accessory on a gliding board, which comprises a base (1) comprising means (2) for fastening the accessory and which accommodates a bar (3) having a toothed part (6) suitable for positioning in a complementary toothed part (16) secured to the gliding board, wherein it comprises a crank (8) that can rotate within the base (1) and one end of which is connected to a lever (9), and wherein the bar (3) has one degree of freedom and a part (7) in contact with a bent part (10) of the crank (8), so that a first position of the lever (9) corresponds to the low position of the toothed part (6) and a second position corresponds to a high position of the toothed part (6) wherein the bar (3) is fastened to the base (1) at one end (4), and wherein the part (7) in contact with the crank (8) lies toward the other end.

2. The device for the adjustable fastening of an accessory on a gliding board as claimed in claim 1, wherein the bar (3) is arranged in the longitudinal direction of the base (1), the toothed part lying substantially in the central part of the base (1).

3. A ski which comprises a device as claimed in claim 1.

4. A device for the adjustable fastening of an accessory on a gliding board, which comprises a base (1) comprising means (2) for fastening the accessory and which accommodates a bar (3) having a toothed part (6) suitable for positioning in a complementary toothed part (16) secured to the gliding board, wherein it comprises a crank (8) that can rotate within the base (1) and one end of which is connected to a lever (9), and wherein the bar (3) has one degree of freedom and a part (7) in contact with a bent part (10) of the crank (8), so that a first position of the lever (9) corresponds to the low position of the toothed part (6) and a second position corresponds to a high position of the toothed part (6), wherein a spring (17) is mounted in the base (1) so as to exert a downward force on the toothed part (6) of the bar (3).

5. The device for the adjustable fastening of an accessory on a gliding board as claimed in claim 4, wherein the crank (8) is transverse to the base and has the bent part (10) in its central part, the lever (9) lying in a lateral zone outside the base (1).

6. The device for the adjustable fastening of an accessory on a gliding board as claimed in claim 4, wherein the lever (9) has a direction substantially parallel to the gliding board when the toothed part (6) is in its low position, and a position at an angle of about 45 degrees upward when the toothed part (6) is in its high position.

7. The device for the adjustable fastening of an accessory on a gliding board as claimed in claim 4, wherein the crank (8) is arranged longitudinally to the base and has the bent part (10) toward its end, the lever (9) lying in a zone to the front or rear of the base (1).

8. The device for the adjustable fastening of an accessory on a gliding board as claimed in claim 4, wherein the lever (9) has a direction substantially parallel to the gliding board when the toothed part (6) is in its low position, and a position raised by one fourth of a turn when the toothed part (6) is in its high position.

9. The device for the adjustable fastening of an accessory on a gliding board as claimed in claim 4, wherein the base (1) comprises at least one location (2) for receiving a ski binding heelpiece, and wherein the lever (9) is positioned toward the front end of the base (1) intended to receive a ski boot.

10. A ski binding heelpiece, wherein it comprises a device for adjustable fastening of its longitudinal position on a gliding board as claimed in claim 4.

11. A ski which comprises a device as claimed in claim 1.

12. A device for fastening an accessory on a gliding board, wherein it comprises a device as claimed in claim 4 and an element (12) which is intended to be securely fastened on the gliding board and comprises a toothed part (15) corresponding to the toothed part (6) of the bar (3).

* * * * *